United States Patent [19]

Ishino et al.

[11] 4,046,983

[45] Sept. 6, 1977

[54] MICROWAVE HEATING OVEN HAVING SEAL MEANS FOR PREVENTING THE LEAKAGE OF MICROWAVE ENERGY

[75] Inventors: Ken Ishino, Nagareyama; Yasuo Hashimoto; Hiroaki Abe, both of Ichikawa, all of Japan

[73] Assignee: TDK Electronics Co., Ltd., Tokyo, Japan

[21] Appl. No.: 695,436

[22] Filed: June 14, 1976

[30] Foreign Application Priority Data

Sept. 3, 1975 Japan ..... 50-106824

[51] Int. Cl.[2] ..... H05B 9/06

[52] U.S. Cl. ..... 219/10.55 D; 174/35 MS

[58] Field of Search ..... 219/10.55 D, 10.55 R, 219/10.55 F; 174/35 R, 35 MS

[56] References Cited

U.S. PATENT DOCUMENTS

| | | | |
|---|---|---|---|
| 3,525,841 | 8/1970 | Haagensen et al. | 219/10.55 D |
| 3,544,751 | 12/1970 | Valles | 219/10.55 D |
| 3,742,176 | 6/1973 | Ishino et al. | 219/10.55 D |
| 3,803,377 | 4/1974 | Nakano | 219/10.55 D |
| 3,809,843 | 5/1974 | Takayama | 219/10.55 D |
| 3,835,283 | 9/1974 | Suzuki | 219/10.55 D |
| 3,866,009 | 2/1975 | Ishino et al. | 219/10.55 D |
| 3,879,595 | 4/1975 | Lamb | 219/10.55 D |
| 3,969,572 | 7/1976 | Rostek | 174/35 MS |
| 4,003,840 | 1/1977 | Ishino et al. | 219/10.55 D X |
| 4,013,861 | 3/1977 | Westfall | 219/10.55 D |

*Primary Examiner*—Arthur T. Grimley

*Attorney, Agent, or Firm*—Burgess, Ryan and Wayne

[57] ABSTRACT

A microwave heating oven has a seal located in the path formed by a gap between the oven body and the oven door for preventing microwave leakage. The seal may comprise several seals, and includes a microwave absorber as one of the seals. The microwave absorber consists of a mixture of a powder of magnetic material and an organic high molecular weight compound. The length of the microwave absorber in the direction of propagation of microwave in the path of microwave leakage is an integral multiple of about $\frac{1}{2}\lambda$, wherein $\lambda$ is a wavelength of the microwave in the microwave absorber. Absorption is improved by setting the absorber in a recess in the wall or door of the oven, or by surrounding the absorber by a metal layer except on the surface thereof parallel to the direction of propagation and facing the gap.

7 Claims, 11 Drawing Figures

MICROWAVE HEATING OVEN HAVING SEAL MEANS FOR PREVENTING THE LEAKAGE OF MICROWAVE ENERGY

BACKGROUND OF THE INVENTION

This invention relates to microwave heating ovens having means for preventing the leakage of microwave energy through a gap between the oven body and the oven door during operation of the heating oven, and is more particularly directed to a microwave heating oven wherein the leakage of microwave energy through the gap is prevented by the insertion of a microwave absorber in the gap.

Microwave heating ovens are utilized for heating articles with microwave energy generated by a microwave generating device, in order to raise the temperatures of the article within a comparatively short time. The frequency of the microwaves used in the present invention is in a high frequency range, such as 2.45 GHz, as is generally known to those skilled in the art.

In the use of this type of oven, microwave energy leaks through a gap, if present, between the body of the microwave heating oven and the door thereof. Such leakage of microwaves generates noise in radio receivers or TV sets, and additionally may cause radio-frequency burns on the human body.

One of the inventors of the present invention, Ishino, has proposed means for preventing the leakage of microwave energy from a microwave heating oven, as disclosed in U.S. Pat. Nos. 3,742,176 and 3,866,009. In the means as stated above, magnetic material is used as one of the seals, i.e. an absorber of the leaking microwave energy, wherein the magnetic material is a mixture of ferrite powder and an organic high molecular weight compound. The ferrite has the formula:

$$MFe_2O_4$$

wherein M is a divalent metal such as Ni, Cu, Zn, Mn, or Mg, and the organic high molecular weight compound is selected from the group consisting of natural rubber and synthetic rubber.

SUMMARY OF THE INVENTION

Briefly stated, the invention provides a microwave heating oven with means for preventing microwave leakage through a gap between the oven body and the oven door during the operation of a microwave heating oven, wherein the means for preventing microwave leakage comprises a microwave absorber consisting primarily of magnetic material comprising a mixture of the powder of ferrite and an organic high molecular weight compound. The microwave absorber is placed in the path of microwave leakage. The organic high molecular weight compound is selected from the group consisting of synthetic rubbers such as polychloroprene, chlorosulfonated polyethylene, chlorinated polyethylene, silicone rubber, fluorine-contained rubber, isobutylene-isoprene rubber and butadiene-acrylonitrile rubber, thermoplastic resins such as polyvinyl chloride, polyethylene, polyproplyene, polyamide and acrylic resin, and thermosetting resins such as epoxy resin, phenol resin and unsaturated polyester resin. The organic high molecular weight compounds have molecular weight of more than 10,000.

The present inventors have found that the leaking microwave energy can be more effectively absorbed by the magnetic material when the microwave absorber in the path of the microwave leakage has a specified length in the direction of propagation of the microwave energy. Specifically, it has been found that the absorption of energy is optimum when the microwave absorber has a length that is a multiple of about 1/2 of the wavelength of the microwave in the absorber. The present invention is based upon this discovery.

The microwave output from a heating oven depends upon the application thereof; that is, the microwave output is different depending on whether the microwave heating oven is used for industrial use or home use. The inventors of the present invention carried out experiments on a microwave heating oven for home use, and the explanation concerning experiments thereon is given in the following paragraphs in conjunction with the accompanying drawings.

Figure 1:
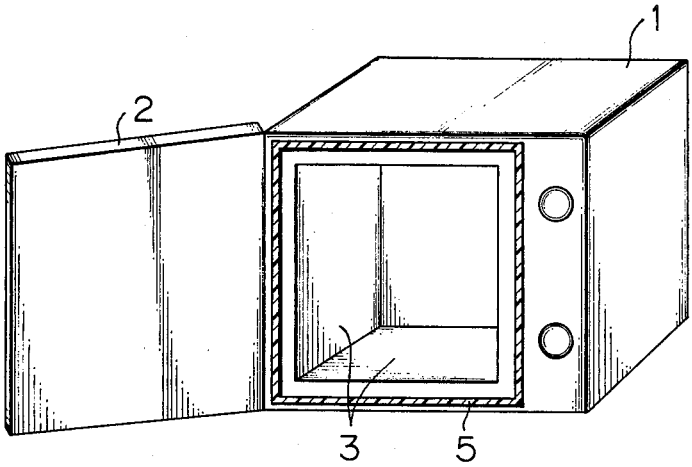
FIG. 1 is a perspective view in simplified form of a microwave heating oven for home use.

FIG. *2a* is an enlarged cross-sectional view of a portion of the microwave heating oven of FIG. 1;

FIG. *2b* is an enlarged cross-sectional view of a modification of the structure of FIG. *2a,* wherein two seals are provided;

FIG. *3a,* FIG. *3b* and FIG. *3c* are longitudinal sectional veiw showing the arrangements of a microwave absorber in a waveguide in experimental tests;

FIG. *3d* is a cross-sectional view along the lines 1—1 of FIGS. *3a* and *3b;*

Figure 4:
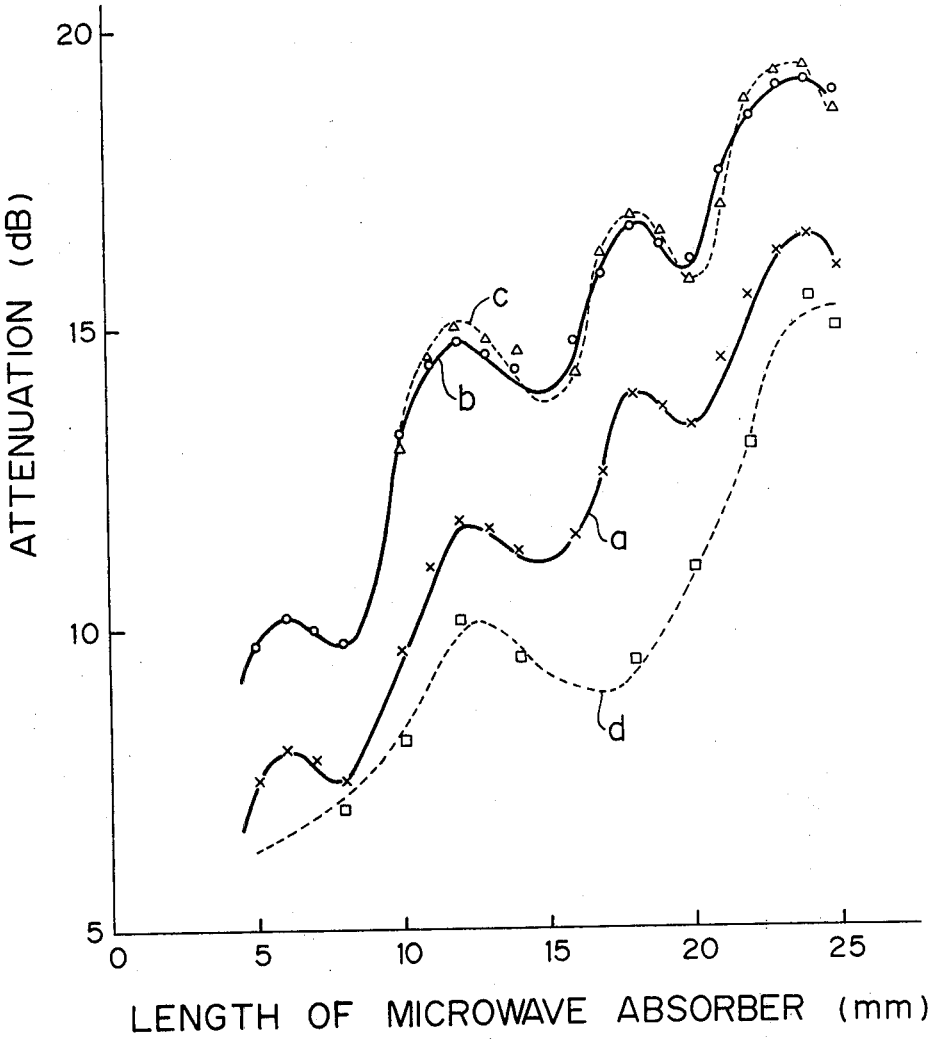

FIG. 4 is a graph showing the relationship between the length of the microwave absorbers shown in FIG. *3a,* FIG. *3b* and FIG. *3c,* and the microwave attenuation;

FIG. *5a,* FIG. *5b* and FIG. *5c* are enlarged cross-sectional views of portions of further modifications of the microwave oven, in accordance with the invention.

DESCRIPTION OF THE INVENTION

In the accompanying drawings FIG. 1, FIG. *2a* and FIG. *2b,* the microwave heating oven consists of a body 1 and a door 2. The body is formed of walls 3, and has an opening in one of said walls 3. The door 2 is provided for closing said opening. Said body 1 and said body 2 in a closed position defines a path 4 through which microwave energy may leak from the inside to the outside of said oven. Leakage prevention means is provided comprising a layer of microwave absorber 5 located directly along one surface defining said path 4. The layer of microwave absorber incompletely blocks the opening of said path 4 and has a surface exposed to said path. Said surface of said microwave absorber and opposed surface of said path forms a gap 6. Said microwave absorber 5 consists of a mixture of the powder of magnetic material such as ferrite and an organic high molecular weight compound. Microwave leakage that would pass through the path 4 is attenuated or blocked by said microwave absorber 5. In FIG. *2b,* a volumetric resonant cavity 7 is provided as another seal. In this case, the microwave leakage is attenuated or prevented by the volumetric resonant cavity 7 (as a first seal) as well as by the microwave absorber 5 (as a second seal).

EXAMPLE 1

A microwave absorber in accordance with the present invention was prepared as follows: 724g of $Fe_2O_3$, 175g of MnO and 101g of ZnO were each weighed out to provide a Mn-Zn-ferrite including 55 mol% of $Fe_2O_3$, 30 mol% of MnO and 15 mol% of ZnO. The $Fe_2O_3$, MnO and ZnO were mixed in a ball mill for 20 hours. The mixture was compression molded at about 1 ton/cm$^2$ to form a shaped body 110mm × 18mm × 5mm. The shaped body was heated at a temperature of 1,350° C for 2 hours. The resulting sintered body, i.e. Mn-Zn-ferrite, was pulverized in a stamp mill to give ferrite powder having particle size of 1μ to 10μ.

The Mn-Zn ferrite powder obtained above was mixed with polychloroprene rubber in the ratio of 5 parts (ferrite powder) to 1 part (polychloroprene) by weight. The mixture was compression molded at about 100 kg/cm$^2$ to form a shaped body having sectional area 5mm × 109mm and the desired length. The shaped bodies having different lengths are the microwave absorbers in the following attenuation tests.

Figure 3A:
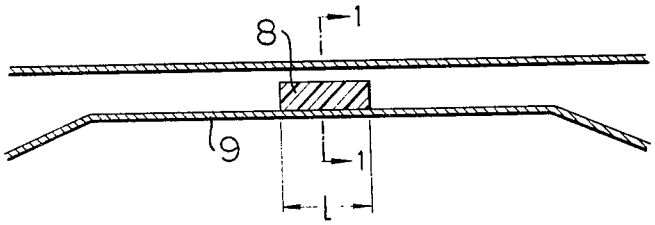

The attenuation of 2.45 GHz microwaves by microwave absorbers formed as above and having the lenths of 5, 6, 7, 8, 10, 11, 12, 13, 14, 16, 17, 18, 19, 20, 21, 22, 23, 24 and 25mm, respectively was then measured in the manner shown in FIG. 3*a*.

Figure 3B:
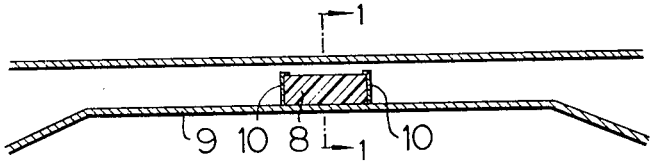
Figure 3C:
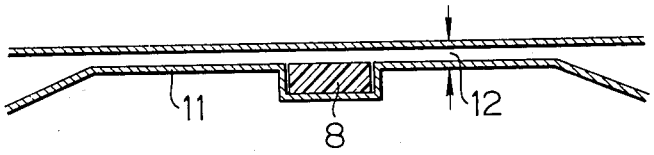
Figure 3D:
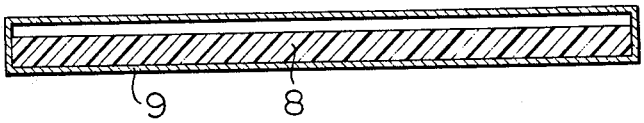

In FIG. 3*d*, a cross sectional view along the lines 1—1 of FIGS. 3*a* and 3*b*.

Referring in FIG. 3*a*, the plate form microwave absorbers 8 having cross sectional area of 5mm × 109mm and the above different lengths were separately inserted into a waveguide 9 (modified type of WRJ-2) having an internal cross sectional area of 7mm × 109mm. The waveguide is made of copper plate. The amounts of attenuation of the microwave were measured, and the value as shown by Curve *a* in FIG. 4 was obtained.

As in apparent from Curve *a*, the peaks of the amount of attenuation were obtained by the microwave absorber having the lengths of 6mm, 12mm, 18mm and 24mm, The wavelength (λ) of 2.45 GHz microwave in the microwave absorbed can be obtained as follows:

$$\lambda_o = c/f = 122\text{mm}$$

$\lambda_o$ = wavelength of 2.45 GHz microwave in air
$c$ = velocity of electromagnetic wave ($3\times10^{10}$ cm)
$f$ = 2.45 GHz $$\lambda = \frac{\lambda_o}{\text{real part of } \sqrt{\dot{\mu}\dot{\epsilon}}} = \frac{\lambda_o}{[\frac{1}{2}\{\sqrt{(\mu'^2+\mu''^2)(\epsilon'^2+\epsilon''^2)} + (\mu'\epsilon' - \mu''\epsilon'')\}]^{\frac{1}{2}}}$$

$\dot{\mu}$ = complex permeability of microwave absorber
$\dot{\epsilon}$ = complex permittivity of microwave absorber
$\mu'$ = real part of $\dot{\mu}$
$\epsilon'$ = real part of $\dot{\epsilon}$
$\mu''$ = imaginary part of $\dot{\mu}$
$\epsilon''$ = imaginary part of $\dot{\epsilon}$ The values of $\mu'$, $\epsilon'$, $\mu''$ and $\epsilon''$ of the microwave absorbers at 2.45 GHz microwave are:

$$\mu' = 2.12,\ \epsilon' = 38,\ \mu'' = 2.8,\ \epsilon'' = 3.6$$

The wavelength λ was obtained by substituting these values into the formula shown above, to obtain:

λ = 12mm.

Accordingly, ½λ is about 6mm, and integral multiples of ½λ are 6mm, 12mm, 18mm, 24mm, etc.

From the results as obtained above, it is apparent that microwave energy can be more effectively absorbed by using microwave absorbers whose lengths along the direction of propagation of microwave in the path of microwave is an integral multiple of about ½λ, wherein λ is the wavelength of the microwave in the microwave absorber.

EXAMPLE II

Referring to FIG. 3*b*, the plate form microwave absorbers 8 of Example I were separately inserted into the waveguide 9 of the type employed in Example I. The microwave absorbers were surrounded by a layer 10 of copper except on the surface therof facing the gap and parallel to the direction of propagation of microwave in the path of microwave. The amounts of attenuation of the microwave at 2.45 GHz were measured, and the values as shown by Curve *b* in FIG. 4 were obtained.

As is apparent from Curve *b*, the amount of attenuation was conspicuously increased by using the microwave absorber which has been surrounded by a metal as shown above.

EXAMPLE III

Referring to FIG. 3*c*, the microwave absorbers 8 formed as in Example I and having lengths of 10, 11, 12, 13, 14, 16, 17, 18, 19, 20, 21, 22, 23, 24 and 25mm respectively, and cross sections of 5mm × 109mm were separately inserted in a metallic cavity formed in waveguide 11. The waveguide 11 has the same width as the waveguide 9 of FIG. 3*a*, i.e., 109mm, and an internal height 12 of 2mm, whereby a 2mm gap exists between the exposed face of the absorber 8 and the opposed wall of the waveguide. The amounts of attenuation of the microwave at 2.45 GHz were measured, and the values shown by Curve *c* in FIG. 4 was obtained. Curve *c* is similar to Curve *b*.

As is apparent from Curve *c*, the amount of attenuation was conspicuously increased by mounting the microwave absorber in a metallic cavity.

EXAMPLE IV

A second microwave absorber was prepared as follows:

754g of $Fe_2O_3$, 118g of NiO and 128g of ZnO were each weighed out to provide a Ni-Zn-ferrite including 60 mol% of $Fe_2O_3$, 20 mol% of NiO and 20 mol% of ZnO. The $Fe_2O_3$, NiO and ZnO were mixed and the mixture was molded to form a shaped body in the same manner as in Example I. The shaped body was heated at a temperature of 1200° C for 2 hours. The resulting sintered body, i.e., Ni-Zn-ferrite, was pulverized to give ferrite powder having particle size of 1μ to 10μ.

The Ni-Zn-ferrite powder obtained above was mixed with polychloroprene rubber in the ratio of 5 parts (ferrite powder) to 1 part (polychloroprene) by weight. The mixture was molded to form a shaped body having sectional area 5mm × 109mm and desired lengths. The shaped bodies having different lengths are microwave absorbers to be used in the present invention.

The attenuation of 2.45 GHz microwaves by these microwave absorbers having lengths of 8, 10, 12, 14, 18, 20, 22, 24 and 25mm, respectively were measured in the manner as shown in FIG. 3*a* by repeating the same procedure as in Example I as stated above. The attenuation values obtained are shown by Curve *d* in FIG. 4.

As in apparent from Curve *d*, in peaks of the amount of attenuation were obtained with microwave absorbers having the lengths of 12mm and 24mm.

The values of $\mu'$, $\epsilon''$, $\mu''$ and $\epsilon''$ these microwaves absorbers at 2.45 GHz microwave were as follows:

$$\mu' = 2.1\ \epsilon' = 9.6\ \mu;41\ ;0\ ;32\ 2.58\ \epsilon'' = 0.40$$

The wavelength ($\lambda$) of 2.45 GHz microwave in these microwave absorbers is about 24mm.

Accordingly, $\frac{1}{2}\lambda$ is about 12mm, and integral multiples of $\frac{1}{2}\lambda$ are 12mm, 24mm, etc.

Microwave energy can thus more effectively be absorbed by using microwave absorbers whose lengths along the direction of propagation of microwave in the path of microwave is an integral multiple of about $\frac{1}{2}\lambda$, wherein $\lambda$ is a wavelength of the microwave in the microwave absorber.

Figure 2A:
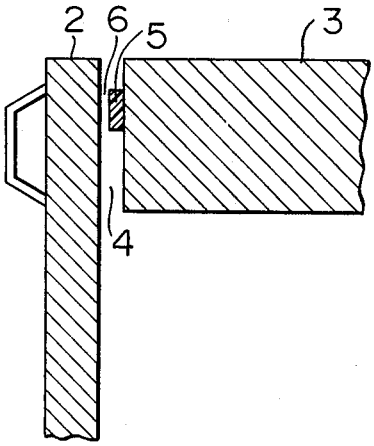
Figure 2B:
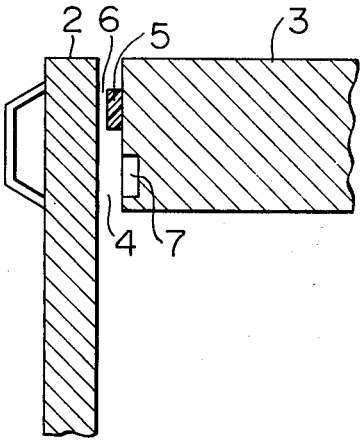

It is thus apparent that attenuation of prevention of microwave leakage is improved by the embodiments of the invention as illustrated in FIGS. 2*a* and 2*b*, when the microwave absorbers 5 have lengths in the direction of propagation of the microwave energy in the leakage path of about $\frac{1}{2}$ wavelength of integral multiples thereof in the microwave absorber. In addition, the microwave absorber with a layer of metal surrounding the sides thereof, except the side facing the gap and parallel to the direction of propagation of microwave energy, as illustrated in FIG. 3*b* may be provided on either the door or the wall of the microwave oven. The arrangement of FIG. 3*c*, wherein the microwave absorber is fully embedded in a recess, may also be employed in either the wall or the door of the microwave oven. In each of the arrangements of FIGS. 3*b* and 3*c*, only face of the microwave absorber is exposed.

Figure 5A:
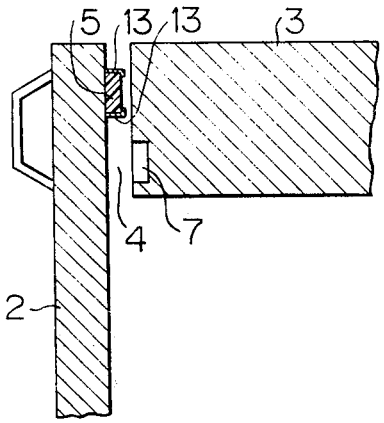
Figure 5B:
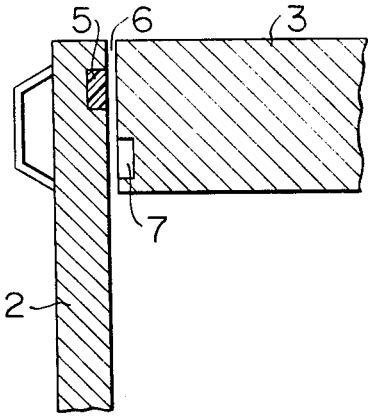
Figure 5C:
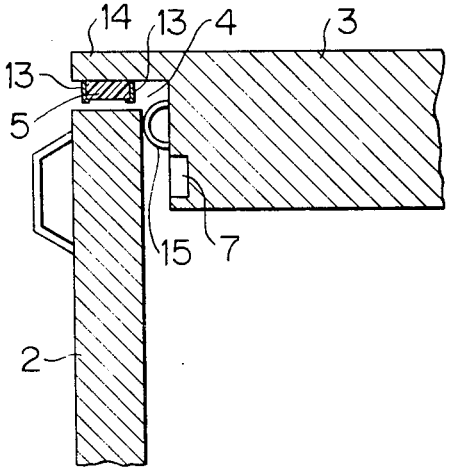

FIGS. 5*a*, 5*b* and 5*c* show further embodiments of the invention. Thus, in FIG. 5*a*, the microwave absorber 5 of the above defined length is provided on the door 2, the sides of the microwave absorber 5 being linked with a layer 13 of metal, so that only one surface thereof facing the gap and parallel to the direction of propagation of microwave energy in the 1 leakage path 4 is exposed. As in the arrangement of FIG. 3*b*, the microwave absorber 5 and the metallic layer 13 thereon project fully into the path 4. In this arrangement, a resonant cavity 7 is provided in the wall 3 at a point preceding the microwave absorber 5 in the direction of propagation of the microwave energy.

In the arrangement of FIG. 5*b*, the microwaves absorber 5 is fully inserted in a recess of the same shape in the door 2, so that only its surface exposed to the gap 6 and parallel to the direction of propagation of microwave energy is exposed. In the arrangement of FIG. 5*b*, a resonant cavity 7 is also provided in the wall 3 of the microwave oven, preceding the location of the microwave absorber 5 in the direction of propagation of the microwave energy.

In the arrangement of 5*c*, the leakage path 4 extends from the inside of the oven parallel to the plane of the door 2, and thence extends outwardly of the oven by virtue of a provision of a lip 14 on the oven, so that the path 4 is L-shaped in cross section. In this embodiment, the microwave absorber 5 is provided on the inside of the lip 14, facing the edge of the door 2, and the edges of the absorber 5 are lined with layers 13 of a metal, as in the arrangement of FIGS. 3*b* and 5*a*, so that the microwave absorber 5 is exposed only on the side thereof facing the gap and parallel to the direction of propagation of microwave energy in this portion of the leakage path 4. The arrangement of 5c also includes a resonant cavity 7 in the wall 3, in the first portion of the leakage path before the right angle bend thereof. A plate form metal spring 15 is placed in the path 4, as illustrated in 5*c*, and this spring 15 may be either on the wall 3 or on the door 2.

It will of course be apparent that the microwave absorbers 5 and resonant cavities 7, in the arrangements of FIGS. 5*a*–5*c* may be placed either on the door or on the wall of the microwave oven, and also that the metal spring 15 as illustrated in FIG. 5*c* may be employed in the arrangements of FIGS. 5*a* or 5*b*, and in such application may be provided on either the door or the wall of the oven.

It is further apparent that seals of the type illustrated in the drawings are preferably employed completely surrounding the circumference of the opening in the oven.

While the above examples only indicate the use of polychloroprene as the organic high molecular weight compound, it will be apparent that other materials such as synthetic rubber, thermoplastic resin and thermosetting resin as shown before can alternatively be employed.

While the invention has been disclosed and described with reference to a limited number of embodiments, it will be apparent that variations and modifications may be made therein without departing from the spirit and scope of the invention, and is intended in the following claims to cover such variations and modifications as falls within the true spirit and scope of the invention.

What is claimed is:

1. In a microwave heating oven comprising a body formed by walls and having an opening in one of said walls; a door provided for closing said opening; said body and said door in a closed position defining a path through which microwave energy may leak from the inside to the outside of said oven; and leakage prevention means comprising a layer of microwave absorber located directly along one surface defining said path, the layer of microwave absorber incompletely blocking the opening of said path and having a surface exposed to said path, whereby said surface of said microwave absorber and opposed surface of said path form a gap therebetween, said microwave absorber consisting of a mixture of the powder of magnetic material and an organic high molecular weight compound, the improvement wherein the length of the microwave absorber along the direction of propagation of microwave in the path of microwave leakage is an integral multiple of about $\frac{1}{2}\lambda$, wherein $\lambda$ is a wavelength of the microwave in the microwave absorber.

2. A microwave heating oven according to claim 1 in which said microwave absorber is surrounded by a metal except on the surface thereof parallel to the direction of propagation of microwave in the path of microwave leakage and facing said opposed surfaces of said path.

3. A microwave heating oven according to claim 2 wherein said microwave absorber extends fully into said path from said one surface, comprising a layer of metal on the sides of said microwave absorber whereby only the surface of said microwave absorber along said direction of propagation and facing said opposed surface is exposed.

4. A microwave heating oven according to claim 1 in which said microwave absorber is mounted in a metallic cavity formed in said one surface of the microwave oven.

5. A microwave heating oven according to claim 1 in which said ferromagnetic material is ferrite having the formula:

$$MFe_2O_4$$

wherein M is a divalent metal such as Ni, Cu, Zn, Mn or Mg.

6. A microwave heating oven according to claim 1 in which said organic high molecular weight compound is selected from the group consisting of synthetic rubber, thermoplastic resin and thermosetting resin.

7. A microwave heating oven according to claim 1 wherein said microwave absorber projects fully from said one surface into said path.

* * * * *

UNITED STATES PATENT OFFICE

CERTIFICATE OF CORRECTION

Patent No. 4,046,983 Dated September 6, 1977

Inventor(s) Ken Ishino, et al

It is certified that error appears in the above-identified patent and that said Letters Patent are hereby corrected as shown below:

Column 2, line 27: "veiw" should be --views--.

Column 5, line 15: "of" (1st occurrence) should be --or--.

line 30: After "only" insert --one--.

line 45: "microwaves" should be --microwave--.

Signed and Sealed this

Second Day of May 1978

[SEAL]

Attest:

RUTH C. MASON
Attesting Officer

LUTRELLE F. PARKER
Acting Commissioner of Patents and Trademarks